US007364494B2

(12) United States Patent
Takeichi et al.

(10) Patent No.: US 7,364,494 B2
(45) Date of Patent: Apr. 29, 2008

(54) EYEGLASS LENS PROCESSING APPARATUS AND METHOD OF PROCESSING EYEGLASS LENS

(75) Inventors: Kyoji Takeichi, Gamagori (JP); Hirokatsu Obayashi, Hoi-gun (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 11/702,188

(22) Filed: Feb. 5, 2007

(65) Prior Publication Data

US 2007/0190899 A1 Aug. 16, 2007

(30) Foreign Application Priority Data

Feb. 3, 2006 (JP) ..... P.2006-027307

(51) Int. Cl.
*B24B 49/14* (2006.01)

(52) U.S. Cl. ..... 451/7; 451/43

(58) Field of Classification Search ..... 451/7, 451/5, 8, 53, 450, 43, 42
See application file for complete search history.

(56) References Cited

U.S. PATENT DOCUMENTS

| | | | | |
|---|---|---|---|---|
| 3,913,274 | A * | 10/1975 | Raiford et al. | 451/5 |
| 6,325,700 | B1 | 12/2001 | Mizuno et al. | |
| 6,328,630 | B1 * | 12/2001 | Jinbo et al. | 451/11 |
| 6,478,657 | B1 | 11/2002 | Shibata | |
| 6,572,460 | B2 * | 6/2003 | Mizuno | 451/178 |
| 6,887,128 | B2 * | 5/2005 | Pierse | 451/7 |
| 6,902,467 | B2 * | 6/2005 | Jinbo | 451/5 |

* cited by examiner

*Primary Examiner*—Robert Rose
(74) *Attorney, Agent, or Firm*—Sughrue Mion, PLLC

(57) ABSTRACT

An eyeglass lens processing apparatus for processing an eyeglass lens includes: a lens chuck that holds the lens; a roughing tool; a finishing tool; a finishing data input unit that inputs finishing data; a water supply unit that supplies water to a portion being processed of the lens; a first temperature sensor that senses temperature of the water to be supplied; and an operating unit that corrects the input finishing data based on the temperature sensed by the first temperature sensor.

8 Claims, 7 Drawing Sheets

EYEGLASS LENS PROCESSING APPARATUS AND METHOD OF PROCESSING EYEGLASS LENS

BACKGROUND OF THE INVENTION

The present invention relates to an eyeglass lens processing apparatus and a method of processing an eyeglass lens.

A periphery of a lens held by lens chucks is processed by a processing tool such as a grindstone, in an eyeglass lens processing apparatus so that the processed lens is fitted to a rim of an eyeglass frame. When a glass lens, a plastic lens, or the like is processed in the above-mentioned apparatus, water is supplied to cool a portion being processed of the lens and to remove scraps of the lens. A circulation method using a water storage tank and a pump has been used as a method of supplying the water. In addition, a waterworks direct-connection method for directly supplying the water from a waterworks is used as the method of supplying the water.

However, when a plurality of lenses is continuously processed in the circulation method, the temperature of the water discharged into the water storage tank rises. For this reason, the water is supplied again while the water is not sufficiently cooled. When the temperature of the water to be supplied is high, the lens is thermally expanded during the processing. Even though the lens is processed using processing data, the lens contracts after the processing. As a result, the size of the processed lens is decreased. In particular, when the processing is performed to form a bevel on the circumferential surface (edge surface) of the lens, it is difficult to fit the processed lens to the rim.

In the related art, the lens is processed so as to have a slight large size and adjustment finishing is then performed to solve the above-mentioned problem. Alternatively, a cooling agent is input to the water storage tank, the temperature rise of the water is suppressed by a cooling unit, or the water in the water storage tank is replaced during the continuous processing. However, the adjustment finishing is troublesome, and processing quality is different for each operator. In addition, the method of suppressing the temperature rise of the water causes much processing cost, and is troublesome.

Meanwhile, the temperature rise of the water in the waterworks direct-connection method is smaller than that in the circulation method. However, since the temperature of the water is changed in seasons, the same problem occurs.

SUMMARY OF THE INVENTION

It is an object of the invention to provide an eyeglass lens processing apparatus and a method of processing an eyeglass lens with a high accuracy.

In order to achieve the above-mentioned object, the invention has the following structure.

(1) An eyeglass lens processing apparatus for processing an eyeglass lens, the apparatus comprising;

a lens chuck that holds the lens;

a roughing tool;

a finishing tool;

a finishing data input unit that inputs finishing data;

a water supply unit that supplies water to a portion being processed of the lens;

a first temperature sensor that senses temperature of the water to be supplied; and an operating unit that corrects the input finishing data based on the temperature sensed by the first temperature sensor.

(2) The eyeglass lens processing apparatus according to (1), wherein the operating unit corrects the input finishing data based on the sensed temperature and a distance between a rotation axis of the lens chuck and a rotation axis of the finishing tool of the input finishing data.

(3) The eyeglass lens processing apparatus according to (1), further comprising a lens-material input unit that inputs a material of the lens, wherein the operating unit corrects the input finishing data based on the sensed temperature and the input material of the lens.

(4) The eyeglass lens processing apparatus according to (1), further comprising a second temperature sensor for sensing temperature in a processing chamber in which the roughing tool and the finishing tool are disposed, wherein the operating unit corrects the input finishing data based on at least one of the temperature sensed by the first temperature sensor and the temperature sensed by the second temperature sensor.

(5) An eyeglass lens processing apparatus for processing an eyeglass lens, the apparatus comprising:

a lens chuck that holds the lens;

a roughing tool;

a finishing tool;

a target lens shape data input unit that inputs target lens shape data;

a water supply unit that supplies water to a portion being processed of the lens;

a first temperature sensor that senses temperature of the water to be supplied; and an operating unit that finds finishing data based on the input target lens shape data and the temperature sensed by the first temperature sensor.

(6) The eyeglass lens processing apparatus according to (5), wherein the operating unit determines a distance between a rotation axis of the lens chuck and a rotation axis of the finishing tool of the finishing data based on a radius of the input target lens shape data and the sensed temperature.

(7) The eyeglass lens processing apparatus according to (5), further comprising a lens-material input unit that inputs a material of the lens, wherein the operating unit determines the finishing data based on the input target lens shape data, the sensed temperature, and the input material of the lens.

(8) The eyeglass lens processing apparatus according to (5), further comprising a second temperature sensor that senses temperature in a processing chamber in which the roughing tool and the finishing tool are disposed, wherein the operating unit determines the finishing data based on the input target lens shape data, and at least one of the temperature sensed by the first temperature sensor and the temperature sensed by the second temperature sensor.

(9) A method of processing an eyeglass lens, the method comprising the steps of:

inputting processing data;

sensing temperature of water to be supplied to a portion being processed of the lens;

correcting the input processing data based on the sensed temperature; and processing the lens based on the corrected processing data.

(10) A method of processing an eyeglass lens, the method comprising the steps of:

inputting target lens shape data;

sensing temperature of water to be supplied to a portion being processed of the lens;

determining processing data based on the input target lens shape data and the sensed temperature; and processing the lens based on the determined processing data.

DESCRIPTION OF THE PREFERRED EBODIMENTS

Figure 1:
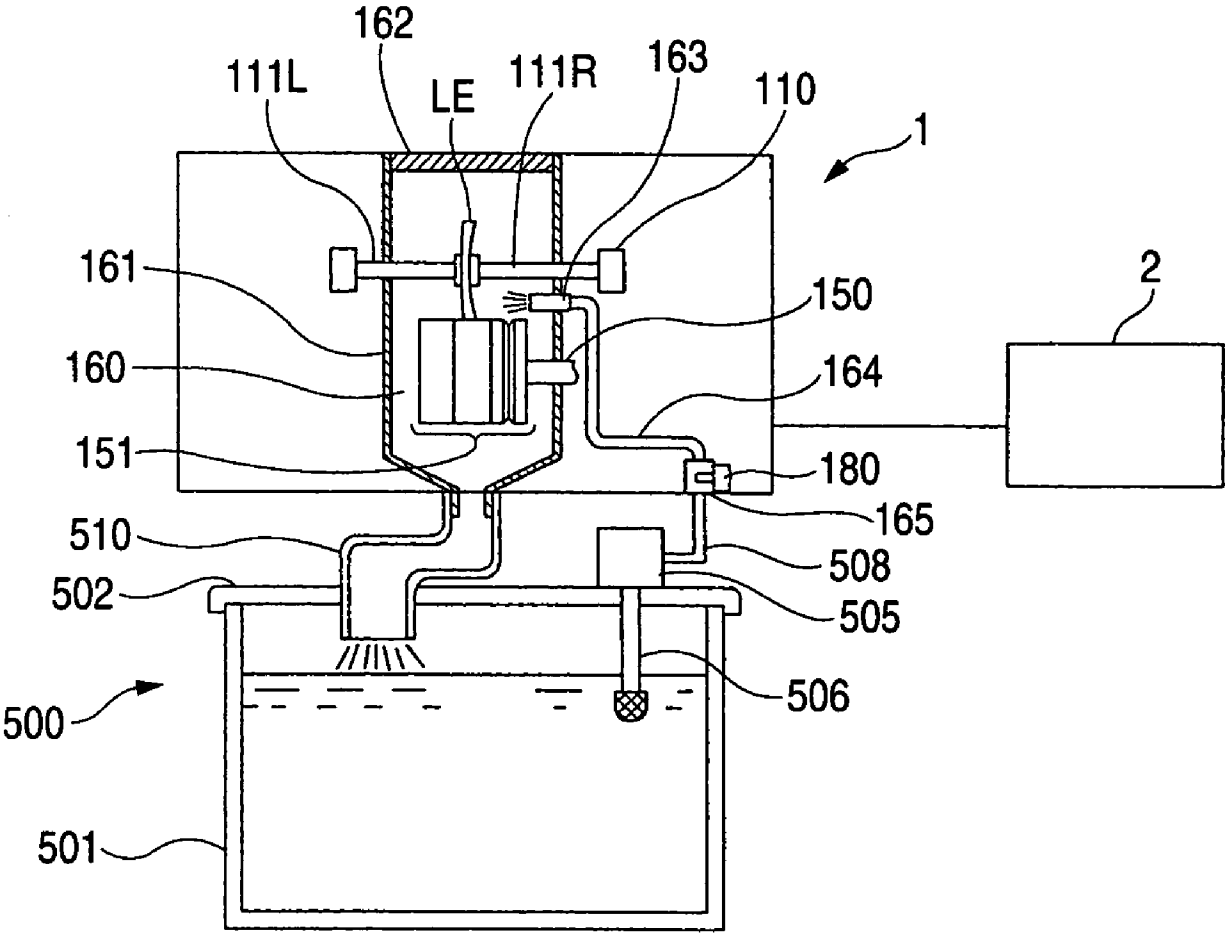
FIG. 1 is a view showing a schematic structure of an eyeglass lens processing apparatus according to an embodiment of the present invention.

Hereinafter, embodiments according to the invention will be described with reference to accompanying drawings. FIG. 1 is a view showing a schematic structure of an eyeglass lens processing apparatus according to an embodiment of the invention. An eyeglass lens processing apparatus 1 is connected with an eyeglass frame measuring device 2. A measuring device disclosed in U.S. Pat. No. 6,325,700B (JP-A-2000-314617), etc. can be used as the measuring device 2. A lens processing unit to be described below is disposed in the processing apparatus 1. A lens LE to be processed is rotated while being held (chucked) by lens chucks 111R and 111L included in a carriage 110, and is processed (ground, edged) by a grindstone 151 used as a processing (grinding, edging) tool that is attached to a grindstone spindle 150 and rotated.

In the processing apparatus 1, a processing chamber 160 is formed by a waterproof cover 161 so that the waterproof cover 161 surrounds the grindstone 151 and the lens held by the lens chucks 111L and 111R. Reference numeral 162 indicates a cover for opening or closing the processing chamber 160. A nozzle 163 for spraying water to a portion being processed of the lens LE by the grindstone 151 is provided in the processing chamber 160. A feed pipe 164 extending from a water inlet 165 is connected to the nozzle 163.

A tank unit 500 provided with a water storage tank 501 is to be disposed below the processing apparatus 1. A pump 505 is provided on a cover 502 of the tank 501. A suction pipe 506 extending into the tank 501 is connected to the pump 505. Further, the pump 505 and the water inlet 165 of the processing apparatus 1 are to be connected with each other through a feed hose 508. In addition; a drain hose 510 extending into the tank 501 is to be connected to a drain outlet, which is disposed below the processing chamber 160 (waterproof cover 161), Water, which is pumped up through the suction pipe 506 by the operation of the pump 505, is fed through the feed hose 508, the water inlet 165, and the feed pipe 164, and is then sprayed from the nozzle 163. The water sprayed from the nozzle 163 and scraps of the lens LE are discharged into the tank 501 through the drain hose 510.

A temperature sensor 180 for sensing water temperature is provided at the water inlet 165 of the processing apparatus 1. Further, the temperature sensor 180 may be provided at any position on a path, through which the water to be supplied to the lens LE flows, in the processing apparatus 1. Alternatively, the temperature sensor 180 may be provided at a position close to the water in the tank 501. The water temperature sensed by the temperature sensor 180 is used to correct the size of the lens LE on the processing (this will be described in detail below).

Figure 2:
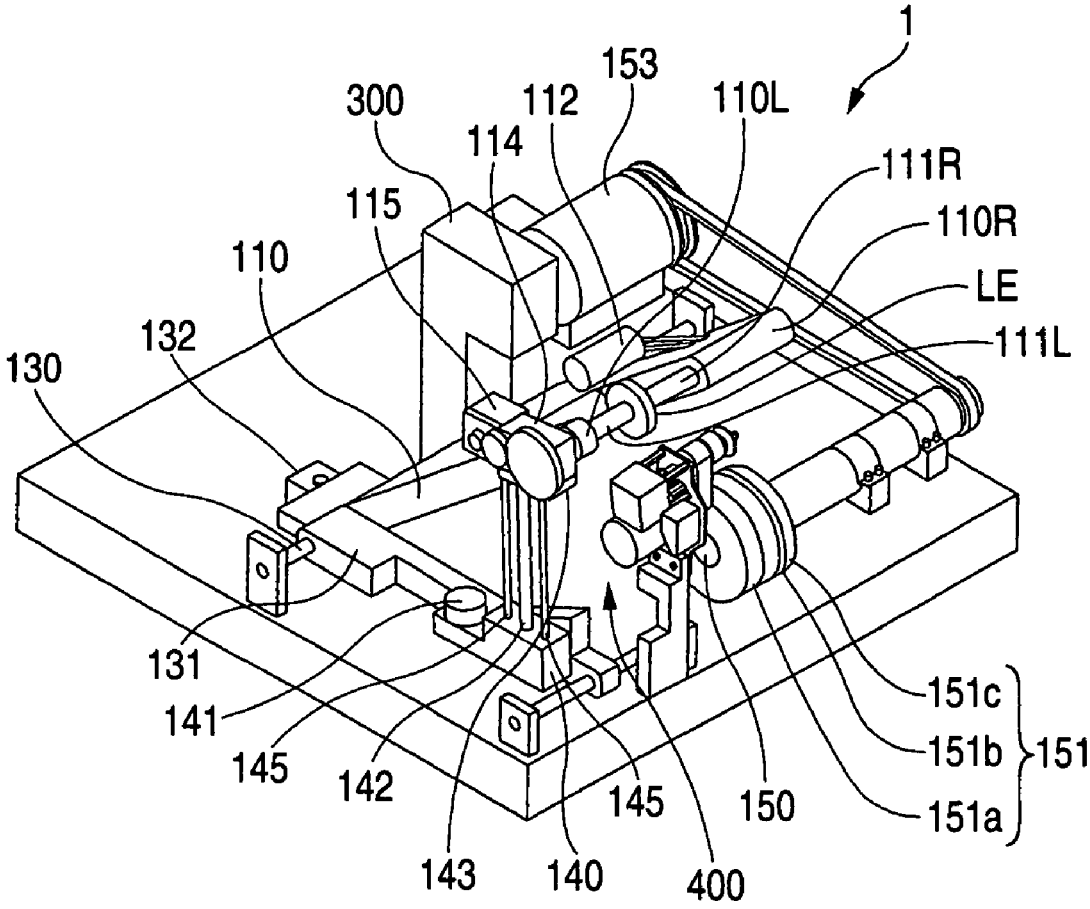
FIG. 2 is a view showing a schematic structure of a lens processing unit.

FIG. 2 is a view showing a schematic structure of a lens processing unit provided in the processing apparatus 1. The grindstone 151 according to the present embodiment includes three grindstones of a roughing grindstone 151*a* for glass, a roughing grindstone 151*b* for plastic, and a finishing grindstone 151*c*. The grindstone 151*c* has a V-shaped groove for beveling and a plane-processing surface. The grindstone spindle 150 is rotated by a grindstone rotating motor 153 via torque transmission members such as a belt.

A block 114 capable of being rotated about a rotation axis of the lens chuck 111L is attached to a left arm 110L of the carriage 110. A lens rotating motor 115 is fixed to the block 114, and the torque of the motor 115 is transmitted to the lens chuck 111L provided to the left arm 110L via torque transmission members such as a gear, so that the lens chuck 111L is rotated. Further, the torque of the lens chuck 111L is transmitted to the lens chuck 111R provided to a right arm 110R of the carriage 110 via torque transmission members such as a belt disposed in the carriage 110, so that the lens chuck 111R is rotated in synchronization with the lens chuck 111L.

When the processing is performed, a cup used as a fixing jig is attached to the front surface (front refractive surface) of the lens LE by an adhesive tape, so that a base of the cup is mounted on a lens receiver provided at the end of the lens chuck 111L. A lens holding (chucking) motor 112 for moving the lens chuck 111R in an axial direction of the lens chuck 111R is fixed, to the right arm 110R, and the torque of the motor 112 is transmitted to the lens chuck 111R via torque transmission members such as a belt and axial movement members disposed in the carriage 110, so that the lens chuck 111R is moved in a direction in which it approaches the lens chuck 111L. A lens retainer is fixed to the end of the lens chuck 111R and the lens retainer comes in contact with the rear surface (rear refractive surface) of the lens LE, so that the lens LE is held (chucked) by the lens chucks 111L and 111R.

The carriage 110 is rotatably and slidably mounted on a carriage shaft 130 parallel to the lens chucks 111L and 111R, and is moved together with a moving arm 131 in the lateral direction (hereinafter, referred to as an "X-direction") that is an axial direction of the carriage shaft 130 by a motor 132 for moving the carriage toward the left or right side. Further, a block 140 capable of being rotated about a rotation axis of the grindstone spindle 150 is attached to the moving arm 131. A motor 141 for moving the carriage vertically (up and down) and two guide shafts 145 are fixed to the block 140, and a lead screw 142 is rotatably attached to the block 140. The torque of the motor 141 is transmitted to the lead screw 142 via torque transmission members such as a belt, so that the lead screw 142 is rotated. A guide block 143 coming in contact with the lower surface of the block 114 is fixed to the upper end of the lead screw 142. The guide block 143 is moved along the guide shafts 145. The carriage 110 is rotated about the carriage shaft 130 in the vertical direction (in a direction in which a distance between the rotation axis of the lens chucks 111L and 111R and the rotation axis of the grindstone spindle 150 is changed. Hereinafter, referred to as a "Y-direction") due to the movement of the guide block 143. Further, a spring is elastically provided between the carriage 110 and the moving arm 131, and the carriage 110 is always pushed downward, so that the lens LE is pressed against the grindstone 151. A known structure of a carriage may be used as the above-mentioned structure of the carriage, which is disclosed in U.S. Pat. No. 6,478,657B (JP-A-2001-18155).

Figure 3:
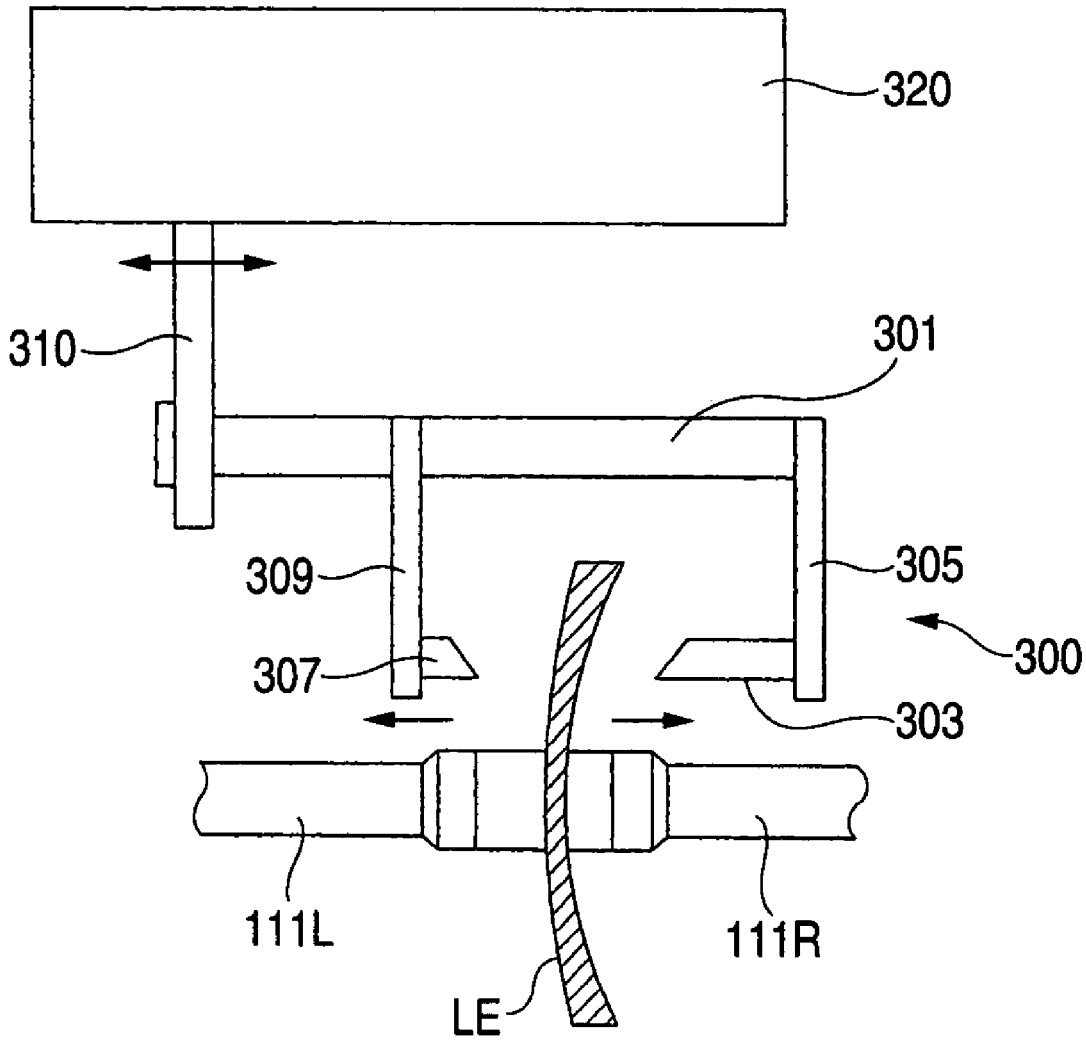
FIG. 3 is a view showing a schematic structure of a lens measuring unit.

A lens measuring unit 300 is disposed on the rear side of the carriage 110. FIG. 3 is a view showing a schematic structure of the lens measuring unit 300 (a unit for measuring the position of the edge of the lens LE). An arm 305 provided with a measuring element 303 for measuring the rear surface of the lens LE is fixed to the right end of a shaft 301. Further, an arm 309 provided with a measuring element 307 for measuring the front surface of the lens LE is fixed to the middle portion of the shaft 301. A line extending between a contact point of the measuring element 303 and a contact point of the measuring element 307 is parallel to the rotation axis of the lens chucks 111L and 111R. The shaft 301 and a slide base 310 can be moved in the axial direction of the lens chucks 111L and 111R. The movement of the shaft 301 (slide base 310) toward the lateral direction (in the X-direction) is detected by a detecting unit 320 that includes a spring pushing the slide base 310 to a starting point, an encoder, and the like.

When the front shape of the lens LE (the position of the front edge of the lens LE) is measured, the lens LE is moved toward the left side in FIG. 3, so that the measuring element 307 comes in contact with the front surface of the lens LE. The measuring element 307 always comes in contact with the front surface of the lens LE due to the spring of the detecting unit 320. In this state, while the lens LE is rotated, the carriage 110 is moved in the Y-direction based on target lens shape data, so that the front shape of the lens LE is measured. Similar to this, when the rear shape of the lens LE (the position of the rear edge of the lens LE) is measured, the lens, LE is moved toward the right side in FIG. 3, so that the measuring element 303 comes in contact with the rear surface of the lens LE. The measuring element 303 always comes in contact with the rear surface of the lens LE due to the spring of the detecting unit 320. In this state, while the lens LE is rotated, the carriage 110 is moved in the Y-direction based on the target lens shape data, so that the rear shape of the lens LE is measured.

A chamfering unit 400 is disposed on the front side of the carriage 110. Since the chamfering unit 400 is not directly related to the invention, the description thereof will be omitted.

Figure 4:
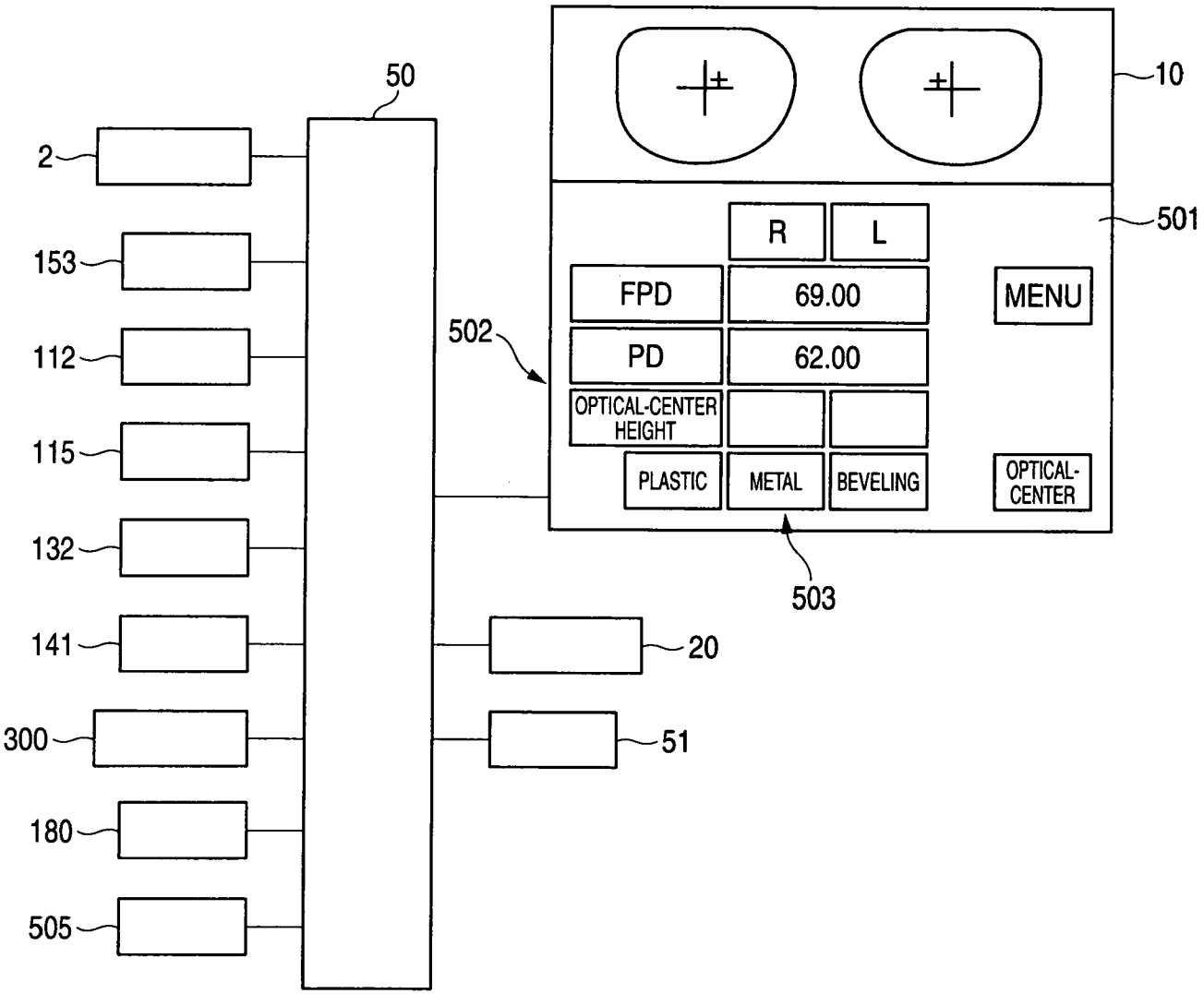
FIG. 4 is a schematic block diagram of a control system of the present apparatus.

FIG. 4 is a schematic block diagram of a control system of the present apparatus. The measuring device 2, a touch screen display (display unit) 10, and a switch panel (operation unit) 20 including a processing start switch and the like, a memory 51, the motors for the lens processing unit, the lens measuring unit 300, the temperature sensor 180, the pump 505, and the like are connected to an operation control unit 50 of the processing apparatus 1.

Next, the operation of a processing system including the processing apparatus 1 will be described. First, target lens shape data is input. Measurement is performed by the measuring device 2 for measuring an eyeglass frame, a template (pattern), a demo lens (model lens), and the like, input is provided from the outside through communication devices, and information previously stored in a data memory is read, so as to perform the input of the target lens shape data. When the target lens shape data is input, a target lens shape graphic based on the target lens shape data is displayed on the display 10, so that layout data and processing conditions can be input. The displaying on the display 10 is controlled by the operation control unit 50.

The layout data such as a pupillary distance PD of a user, a frame pupillary distance FPD, a height of an optical center of a lens with respect to a geometric center of the target lens shape, and the like is input by using buttons (keys) 502 displayed in an input field 501 on an input screen of the display 10. Further, processing conditions, such as a material of a lens, a material of a frame, and a processing mode (a bevel-finishing mode or a flat-finishing mode) are input by buttons (keys) 503 displayed in the input field 501. The following case will be described in the present embodiment. In this case, plastic is input as the material of the lens, metal is input as the material of the frame, and the bevel-finishing mode is input as the processing mode.

When the data required for the processing is input, the lens LE is held (chucked) by the lens chucks 111L and 111R and the processing start switch of the switch panel 20 is operated, so that the apparatus is operated. First, the operation control unit 50 determines (calculates) new target lens shape data rσn and rθn (n=1, 2, 3, . . . , N) based on the rotation center (processing center) of the lens LE (the rotation axis of the lens chucks 111L and 111R) based on the input target lens shape data and layout data. rσn indicates a radius of the target lens shape data, and rθn indicates a radial angle of the target lens shape data. Next, the operation control unit 50 operates the lens measuring unit 300 so as to measure the positions of the front and rear edges of the lens LE based on the new target lens shape data. After that, the operation control unit 50 determines (calculates) data rσn, rθn, and yzn (n=1, 2, 3, . . . , N) of a path of a bevel to be formed on the circumferential surface of the lens LE based on data on the measured edge positions. yzn indicates a position of an apex of the bevel in the X-direction. For example, the path of the bevel is determined (calculated) at the path of the apex of the bevel so that the bevel apex path divides the measured edge thickness at a predetermined ratio (for example, 3:7).

The bevel path data is obtained, and the operation control unit 50 then determines (calculates) bevel-finishing data. A processing point when the lens LE is rotated is determined (calculated) based on a radius R of the finishing grindstone 151*c*, and a distance L between the rotation center (processing center) of the lens LE and the rotation center of the grindstone 151*c*(a distance between the rotation axis of the lens chucks 111L and 111R and the rotation axis of the grindstone spindle 150 (grindstone 151)), which corresponds to each rotation angle of the lens LE, is determined, so that the bevel-finishing data is obtained. The calculation of the bevel-finishing data is performed as follows: the bevel path data (target lens shape data) rσn and rθn is assigned into the following Equation 1 to determine (calculate) the maximum value of L.

$$L = r\sigma n \cdot \cos r\theta n + \sqrt{R^2 - (r\sigma n \cdot \sin r\theta n)^2} \quad (n=1, 2, 3, \ldots, N) \qquad \text{Equation 1}$$

According to the above-mentioned calculation, the bevel path data (target lens shape data) rσn and rθn is rotated one rotation (every rotation angle) about the processing center by a predetermined minute unit angle, and the maximum value of L is determined (calculated). The rotation angle is indicated by ξi (i=1, 2, 3, . . . , N), and the calculation is performed for one rotation (every rotation angle). The maximum value of L, which corresponds to each the rotation angle ξi, is indicated by Li and the radial angle rθn in this case is indicated by θi. As a result, the bevel-finishing data Li, ξi, and θi (i=1, 2, 3, . . . , N) is obtained. Further, the processing point in the X-direction becomes yzn corresponding to the radial angle θi.

Roughing data is obtained as data that is larger than the bevel-finishing data by a margin for the bevel-finishing.

When the roughing data and bevel-finishing data have been obtained, first, the operation control unit 50 rotates the lens LE and moves the carriage 110 in the X-direction and Y-direction based on the roughing data, so that the lens LE is processed by the roughing grindstone 151*b*. In this case, the pump 505 is operated, so that the water in the tank 501 is sprayed through the nozzle 163 to the portion being processed of the lens LE. At this time, the temperature sensor 180 senses the water temperature, and the sensing signal of the temperature sensor 180 is input to the operation control unit 50.

Figure 5:
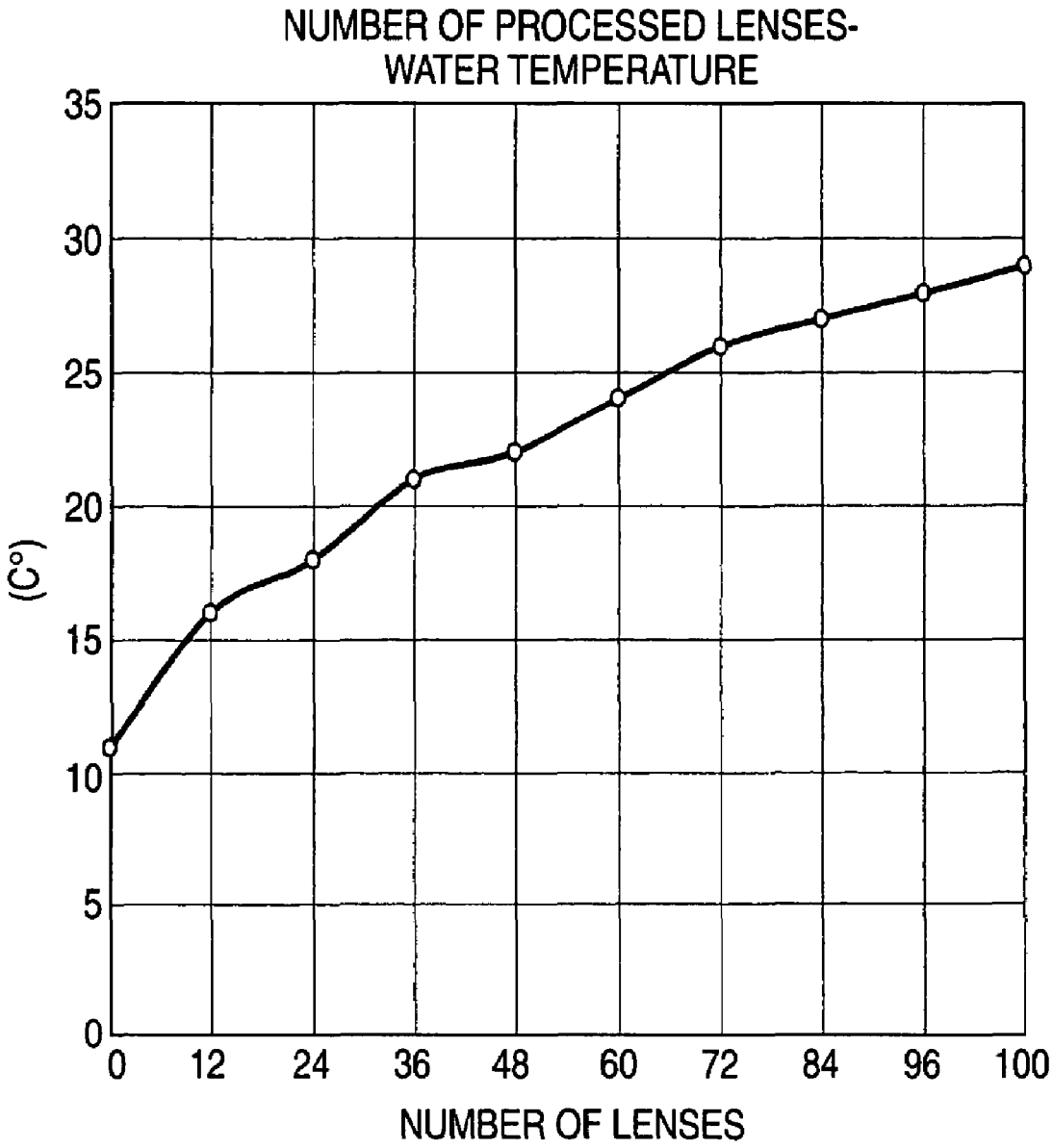
FIG. 5 is a graph showing a relationship between the number of processed lenses and water temperature.

When a plurality of lenses is continuously processed, the water temperature gradually rises in the tank 501. FIG. 5 is a graph showing a relationship between the number of the processed lenses and the water temperature, and shows results obtained from experiments. The water temperature is about 10° C. before the beginning of the processing. As the number of the processed lenses is increased, the water temperature rises. When the number of the processed lenses is 100, the water temperature rises up to about 30° C.

Figure 6:
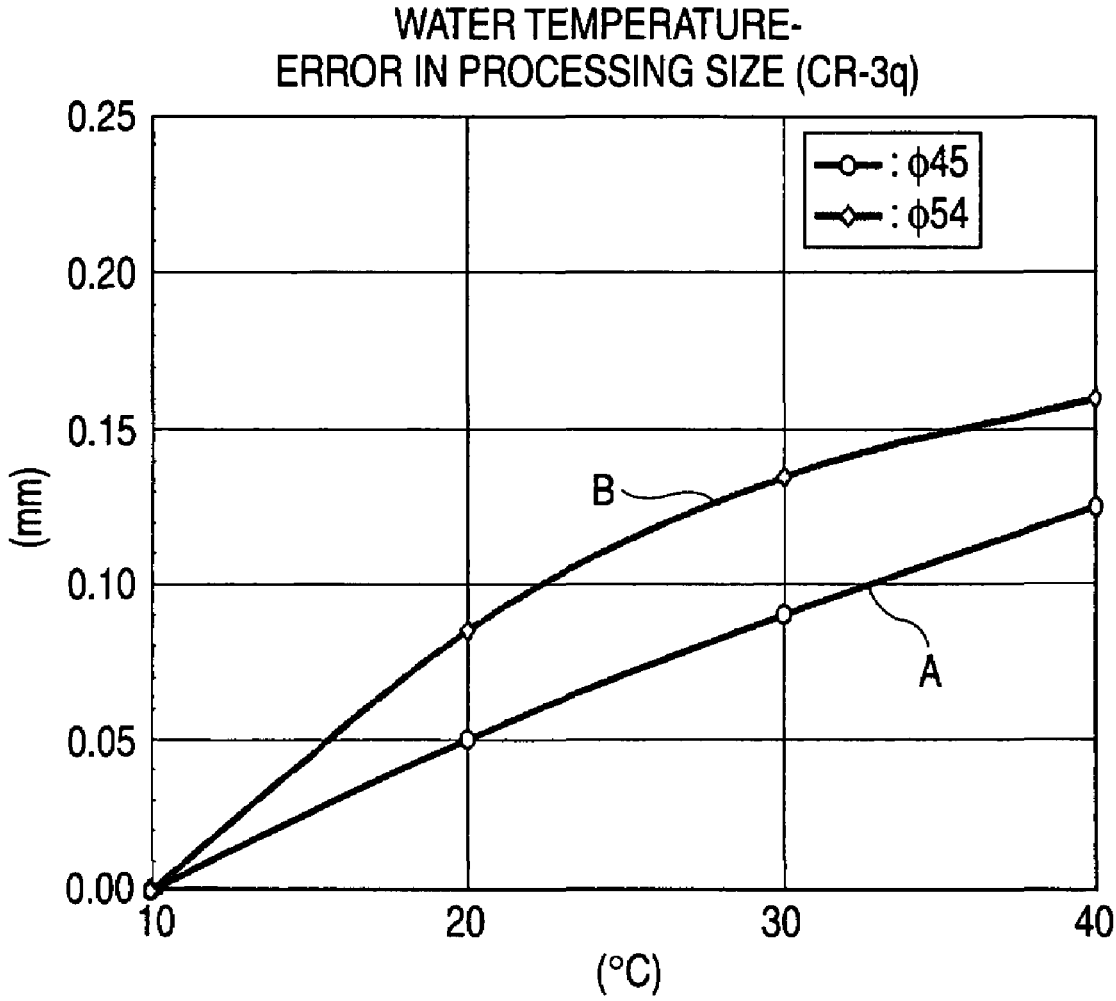
FIG. 6 is a graph showing a relation between an error in size of a processed plastic lens and water temperature.

FIG. 6 is a graph showing a relation between an error in size of a processed plastic lens (a lens is made of a general CR-39) and the water temperature, and shows results obtained from experiments. Graph A shows the error in size of the processed plastic lens, when the radius of the bevel path data (target lens shape data) is 22.5 mm (the diameter is 45 mm). Further, Graph B shows the error in size of the processed plastic lens, when the radius of bevel path data (target lens shape data) is 27 mm (the diameter is 54 mm). As the water temperature rises, the error in size of the processed plastic lens is increased. In addition, when the radius of the bevel path data (target lens shape data) is set to be large, variation due to the thermal expansion is increased. For this reason, the error in size of the processed plastic lens is further increased.

Accordingly, the operation control unit 50 corrects the bevel path data (target lens shape data) or the bevel-finishing data in accordance with the water temperature. Preferably, the operation control unit 50 changes the amount of correction in accordance with the radius of the bevel path data (target lens shape data), or the distance between the rotation center of the lens LE and the rotation center of the grindstone 151*c* of the bevel-finishing data. The amount of correction corresponding to the water temperature, the radius, or the distance between the rotation centers is previously stored in the memory 51 in the form of a table. Further, the operation control unit 50 reads the amount of correction from the memory 51 to set the amount of correction based on the water temperature at the processing, the radius, or the distance between the rotation centers.

When the lens is made of glass, the coefficient of the thermal expansion is small. For this reason, there is no error in size of the processed plastic lens caused by the variation in the water temperature. Accordingly, when the lens is made of the glass, the amount of correction may be zero. Further, the lens is made of high refractive plastic, the error in size of the processed plastic lens caused by the variation in the water temperature is substantially equal to or slightly smaller than the error in size of the processed lens made of the general plastic (CR-39). Accordingly, the material of the lens may also be considered to previously store the amount of correction in the form of a table.

When the temperature sensor 180 senses the water temperature, the operation control unit 50 sets the amount ΔR of correction from the data stored in the memory 51 based on the water temperature, the radius of the bevel path data (target lens shape data), or the distance between the rotation centers of the lens and the grindstone of the bevel-finishing data. Further, the operation control unit 50 determines (calculates) data, which is obtained by correcting the radius rσn corresponding to each radial angle rθn of the bevel path data (target lens shape data) rσn and rθn with the amount ΔR of correction, and then determines (calculates) the bevel-finishing data Li, ξi, and θi (i=1, 2, 3, . . . , N) by using the above-mentioned Equation 1. Alternatively, the operation control unit 50 determines (calculates) data, which is obtained by correcting the distance Li corresponding to each radial angle θi of the bevel-finishing data Li, ξi, and θi with the amount ΔR of correction.

When the roughing is completed, the operation control unit 50 rotates the lens LE and moves the carriage 110 in the X-direction and Y-direction based on the corrected bevel-finishing data, so that the lens LE on which the roughing is performed is processed by the finishing grindstone 151*c*. Even in this case, the water in the tank 501 is sprayed through the nozzle 163 to the portion being processed of the lens LE.

According to the above-mentioned embodiment, the bevel-finishing data is corrected in accordance with the variation in the water temperature. However, it is more preferable that the bevel-finishing data be corrected in accordance with variation in temperature in the processing chamber 160. In the case when a plurality of lenses is continuously processed, as the number of the processed lenses is increased, the temperature in the processing chamber 160 rises (the temperature rises by a temperature of 10° C. or more). In particular, when the water cannot be used in the roughing and finishing, that is, when the lens is made of a material such as polycarbonate, the temperature in the processing chamber 160 further rises (the temperature rises by a temperature of 20° C. or more). Accordingly, the bevel-finishing data is corrected in accordance with the temperature in the processing chamber 160.

Figure 7:
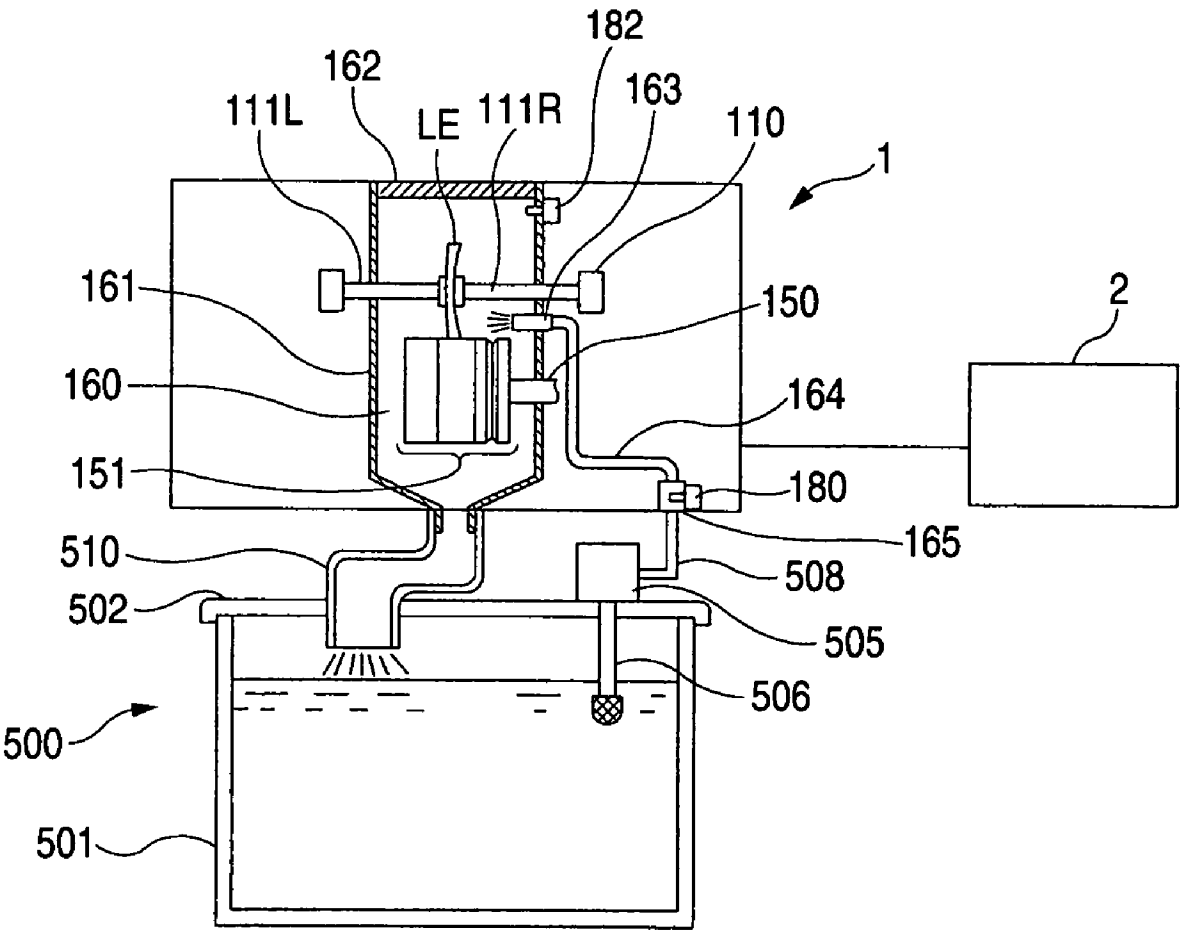
FIG. 7 is a view showing a schematic structure of an eyeglass lens processing apparatus that is provided with a temperature sensor for sensing temperature in a processing chamber.

FIG. 7 is a view showing a schematic structure of an eyeglass lens processing apparatus that is provided with a temperature sensor 182 for sensing the temperature in the processing chamber 160. The temperature sensor 182 is attached to the waterproof cover 161 so as to sense the temperature in the processing chamber 160. The sensing signal of the temperature sensor 182 is input to the operation control unit 50, and the operation control unit 50 corrects the bevel-finishing data in accordance with the signal. In addition, it is preferable that the temperature sensor 182 be provided at the upper portion of the processing chamber 160 in order not to come in contact with the water sprayed through the nozzle 163.

The correction of the bevel-finishing data in accordance with the temperature in the processing chamber 160 is performed in the same manner as the correction in accordance with the water temperature. That is, the bevel path data (target lens shape data) or the bevel-finishing data is corrected in accordance with the temperature of the processing chamber 160. Preferably, the amount of correction is changed in accordance with the radius of the bevel path data (target lens shape data), or the distance between the rotation centers of the lens and the grindstone of the bevel-finishing data. The amount of correction corresponding to the temperature in the processing chamber 160, the radius, or the distance between the rotation centers is previously stored in the memory 51 in the form of a table. Further, the operation control unit 50 reads the amount of correction from the memory 51 to set the amount of correction based on the water temperature of the processing chamber 160 at the processing, the radius, or the distance between the rotation centers.

Further, it goes without saying that the case of the flat-finishing mode is similar to that of the bevel-finishing mode.

What is claimed is:

1. An eyeglass lens processing apparatus for processing an eyeglass lens, the apparatus comprising:

a lens chuck that holds and rotates the lens;

a roughing tool to be rotated;

a finishing tool to be rotated;

a finishing data input unit that inputs finishing data including a center-to-center distance between a rotation center of the lens and a rotation center of the finishing tool;

a water supply unit that supplies water to a portion being processed of the lens;

a first temperature sensor that senses temperature of the water to be supplied; and an operating unit that corrects the center-to-center distance of the input finishing data based on the temperature sensed by the first temperature sensor.

2. The eyeglass lens processing apparatus according to claim 1, further comprising a lens-material input unit that inputs a material of the lens, wherein the operating unit corrects the center-to-center distance of the input finishing data based on the sensed temperature and the input material of the lens.

3. The eyeglass lens processing apparatus according to claim 1, further comprising a second temperature sensor for sensing temperature in a processing chamber in which the roughing tool and the finishing tool are disposed, wherein the operating unit corrects the center-to-center distance of the input finishing data based on at least one of the temperature sensed by the first temperature sensor and the temperature sensed by the second temperature sensor.

4. An eyeglass lens processing apparatus for processing an eyeglass lens, the apparatus comprising:

a lens chuck that holds and rotates the lens;

a roughing tool to be rotated;

a finishing tool to be rotated;

a target lens shape data input unit that inputs target lens shape data including a radius;

a water supply unit that supplies coolant water to a portion being processed of the lens;

a first temperature sensor that senses temperature of the water to be supplied; and an operating unit that corrects the radius of the input target lens shape data based on the temperature sensed by the first temperature sensor and finds finishing data including a distance between a rotation center of the lens and a rotation center of the finishing tool based on the corrected radius.

5. The eyeglass lens processing apparatus according to claim 4, further comprising a lens-material input unit that inputs a material of the lens, wherein the operating unit corrects the radius of the input target lens shape data based on the sensed temperature and the input material of the lens.

6. The eyeglass lens processing apparatus according to claim 4, further comprising a second temperature sensor that senses temperature in a processing chamber in which the roughing tool and the finishing tool are disposed, wherein the operating unit corrects the radius of the input target lens shape data based on at least one of the temperature sensed by the first temperature sensor and the temperature sensed by the second temperature sensor.

7. A method of processing an eyeglass lens by a processing tool, the method comprising the steps of:

inputting processing data including a center-to-center distance between a rotation center of the lens and a rotation center of the processing tool;

sensing temperature of coolant water to be supplied to a portion being processed of the lens;

correcting the center-to-center distance of the input processing data based on the sensed temperature; and processing the lens based on the corrected processing data.

8. A method of processing an eyeglass lens by a processing tool, the method comprising the steps of:

inputting target lens shape data including a radius;

sensing temperature of coolant water to be supplied to a portion being processed of the lens;

correcting the radius of the input target lens shape data based on the sensed temperature and determining processing data based on the corrected radius; and processing the lens based on the determined processing data.

* * * * *